United States Patent [19]

Suh et al.

[11] 4,034,966

[45] July 12, 1977

[54] METHOD AND APPARATUS FOR MIXING PARTICLES

[75] Inventors: Nam P. Suh, Sudbury; Charles L. Tucker, III, Medford both of Mass.

[73] Assignee: Massachusetts Institute of Technology, Cambridge, Mass.

[21] Appl. No.: 628,966

[22] Filed: Nov. 5, 1975

[51] Int. Cl.[2] ..... B01F 15/00

[52] U.S. Cl. ..... 259/4 R

[58] Field of Search ..... 259/1 R, 2–10, 259/18–27, 180, DIG. 46; 239/15; 250/325, 326

[56] References Cited

U.S. PATENT DOCUMENTS 3,856,269 12/1974 Fothergill ..... 259/4 R

*Primary Examiner*—Edward J. McCarthy

*Attorney, Agent, or Firm*—Arthur A. Smith, Jr.; Robert F. O'Connell

[57] ABSTRACT

A method and apparatus for forming a mixture of solid particles of two different types wherein the particles of one type are electrically charged with a charge of one polarity, e.g., a positive polarity, and the particles of the other type are electrically charged with a charge of the opposite polarity,e.g., a negative polarity. The charged particles are combined over a selected time period during which they retain their mobility so that at the end of such time period they form a mixture the characteristic of which is better than a random mixture, i.e., the ratio of the number of particles of one type to the number of particles of the other type in each of a plurality of samples thereof tends to be the same as the ratio of the number of particles of said one type to the number of particles of the other type in the overall mixture.

10 Claims, 3 Drawing Figures

METHOD AND APPARATUS FOR MIXING PARTICLES

The Government has rights in this invention pursuant to NSF Cooperative Agreement CG–00006 awarded by the National Science Foundation.

INTRODUCTION

This invention relates generally to methods and apparatus for mixing particles of different materials and, more particularly, for mixing solid particles by electrostatic charging thereof.

BACKGROUND OF THE INVENTION

Many processes require the mixing of solid particles of different materials, particularly when such particles are relatively small, e.g., of powder sizes in a range from about 1 micron to about 1 millimeter. For example, such mixtures may be required in mixing dry materials to form pills or other drug dosage forms, in mixing plastic materials such as polymeric plastic paticles for molding purposes, in mixing additives to materials, such as vitamin additives to flour in bread making processes or filler material in plastics for coloring or strengthening the plastic. Other uses will occur to those in the art.

The use of presently available mechanical mixing devices tends to provide mixtures of solid particles which are described at best as "random" mixtures. A random mixture can be described as one in which the probability that any particle is of a specified type is the same at all points in the mixture, such probability being equal to the fraction of that type of particle which is in the mix. For a random mixture, as defined, the number of particles of one type in a plurality of samples of the same size follows the binomial distribution. In many applications a random mixture, or even a mixture which is not as good as a random mixture, may be adequate. Thus, random mixtures may be adequate in cases where the smallest sample size of the mixture that is of interest contains a very large number of particles, in which cases each sample size contains the mixed components in the desired ratio within an acceptable error.

However, in many applications where, for example, the smallest sample size of interest contains only a relatively small number of particles, the variation among samples associated with a random mixture may not be acceptable. Sometimes this problem can be circumvented by reducing the sizes of the particles being mixed so as to create a larger number of particles in the smallest sample size of interest. With conventional devices a random mixture is always the best that can be achieved. A random mixture of smaller particles is better than a random mixture of larger particles. However, a problem arises when the particle size cannot be reduced further than a minimum size and a better than random mixture is still needed or is at least desired.

A "perfect" mixture can be defined as one in which each component is evenly distributed throughout the mixture so that with reference to the smallest sample of interest, the ratio of the particle components in every such sample is the same as the ratio of components in the entire mixture, so long as the sample size is greater than the individual particle sizes. In many applications in which a random mixture is not acceptable, it is desirable to provide a mixture which tends toward and approaches as best as possible a perfect mixture as so defined.

BRIEF SUMMARY OF THE INVENTION

In accordance with the invention, in mixing solid particles of two different types the particles of one type are each provided wth an electrical charge of one polarity, e.g., a negative electrical charge, and the particles of the other type are each provided with an electrical charge of the opposite polarity, e.g., a positive electrical charge. The charged particles are then permitted to come into contact so as to be combined. Groups of particles having like charges will tend to repel and spread apart from each other and groups of particles having unlike charges will tend to attract and combine with each other. Once an unlike pair is combined it will remain combined as long as the particles retain their individual charges. The mixing of such charged particles provides a mixture which is improved over the random mixtures provided by purely mechanical mixing processes and the improved mixing process produces mixtures which are closer to perfect mixtures than those provided by presently available process of the prior art. Thus, in a mixture of particles of two different types formed in accordance with the invention, the ratio of the number of particles of one type to the number of particles of the other type in each of a plurality of samples tends to bethe same as the ratio of the number of particles of the two types in the overall mixture.

DESCRIPTION OF THE INVENTION

The invention can be described in more detail with the help of the accompanying drawings wherein FIG. 1. shows a diagrammatic view of a sample of a perfect mixture of solid paticles of two different types;

Figure 1:
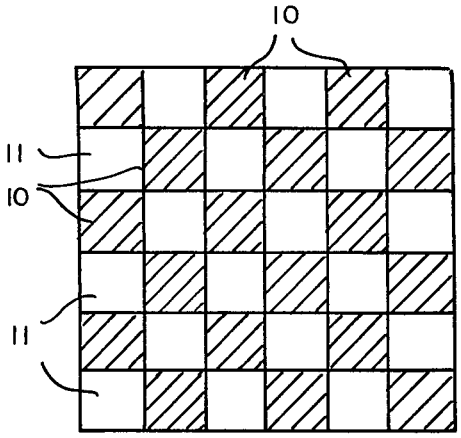

As can be seen in FIG. 1, solid particles 10 of a first type shown in black and solid particles 11 of a second type shown in white are both evenly distributed throughout a perfect mixture. A sample thereof, as shown in FIG. 1, will contain a ratio of the number of the first and second particles which is the same as the ratio thereof in the whole mixture. Thus, if the same number of particles of each type are to be combined, each sample will contain equal numbers of each type of particle.

Figure 2:
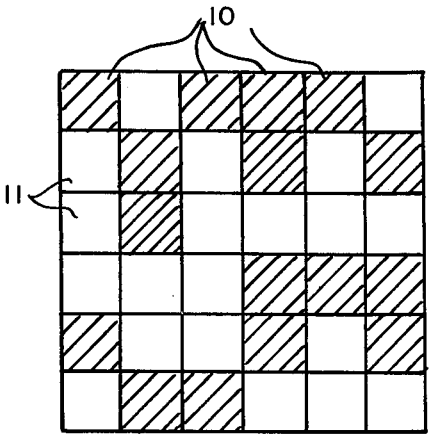
FIG. 2 shows a diagrammatic vview of a sample of random mixture of such solid particles.

As can be seen in FIG. 2, in a random mixture the probability of any particle being of a certain type is the same at all points of the mixture and is equal to the fraction of that type in the overall mixture. Different samples thereof will not contain the components in the same ratio from sample to sample. It can be shown that the statistical standard deviation, $\sigma_r$, for a random mixture of the number of particles of one type among samples each containing "n" particles is given by:

$$\sigma_r = \sqrt{a(1/-a)n}$$

where $a$ is the fraction of that type of particle in the random mixture. In a completely "unmixed" combination of particles the statistical standard deviation, "S", will be at a maximum while as the mixture becomes closer to a perfect mixture the statistical standard deviation decreases and at a perfect mixture state S wll reach zero.

In evaluating the quality of a mix a quantitative measure can be determined by countin the number of particles of one type in a plurality of separate samples each having a total of n particles. The square of the statistical standard deviation, S, thereof is computed and compared with the square of the standard deviation $\sigma_r$ expected from a random mixture. A mixing index M can then be defined as $$M = S^2/\sigma_r^2$$

If $M = 1$ the mixture is defined as a random mixture. If $M<1$ the mixture is better than a random mixture (tending toward a perfect mixture) and if $M>1$ the mixture is worse than a random one (tendng away from a perfect mixture.). A perfect mixture can be defined as one in which $M=0$.

Let it be assumed that a mixture of two different types of particles having equal proportions is produced wherein at least some of the particles of one type are paired with those of the other type. In each sample of n particles there will be $p$ pairs thereof and $r$ other unpaired particles. If the $r$ particles are randomly mixed, the variance for that portion of the overall mixture will be equal to the variance of a random mixture with $r$ particles per sample. In this case, $M=1-p/n$. In the later stages of a mixing process wherein pairs of particles occur as in an electrical charging technique of the invention, if the un-paired particles are more or less randomly distributed, the proportion of particles that are perfectly mixed through the electrical charging effects will be equal to 1−M.

One technique and implementation thereof in accordance with the invention is described in connection with the apparatus of FIG. 3. In demonstrating the efficiency of the invention such apparatus was used to mix particles substantially identical in size and weight in substantially equal proportions, such as particles A and particles B placed in suitable containers 15 and 16. The particles were supplied from output openings 17 and 18 of the containers to appropriate conduits 19 and 20 by means of a flow of air from a source 21 thereof via a common conduit 22 through conduits 23 and 24 and thence to the input openings 25 and 26 of the containers. Appropriate valves 27, 28, 29, 30 and 31 control the flow of air and the flow of particles as desired.

The particles are then conveyed in streams 32 and 33 on to downwardly directed channels 34 and 35 which direct the flow thereof past corona discharge devices 36 and 36'. The latter devices comprise high voltage corona point electrodes 37 and 38 and ground electrodes 39 and 40. Electrode 37 is supplied with a positive voltage with respect to ground and corona electrode 38 is supplied with a negative voltage, each being so supplied by suitable power supply sources 41 and 42. The corona discharge across the electrodes causes the air particles therebetween to ionize and the ionized air particles combine with the particles A and B as they pass between the electrodes so as to impart a positive and negative charge on the particles, respectively. In a practical embodiment the corona power supplies may, for example, provide voltages which produce electric fields of about 5–15 KV./cm.

Because of the charged nature of the particles in each stream there is a spreading thereof as each stream leaves the region of each corona discharge device since the charged particles tend to repel each other. The charged particles are directed so as to enter a mixing chamber 43 and during entry the streams of oppositely charged particles attract each other so that particles of one material tend to pair up with particles of the other material as both streams are conveyed downwardly through the mixing chamber.

Figure 3:
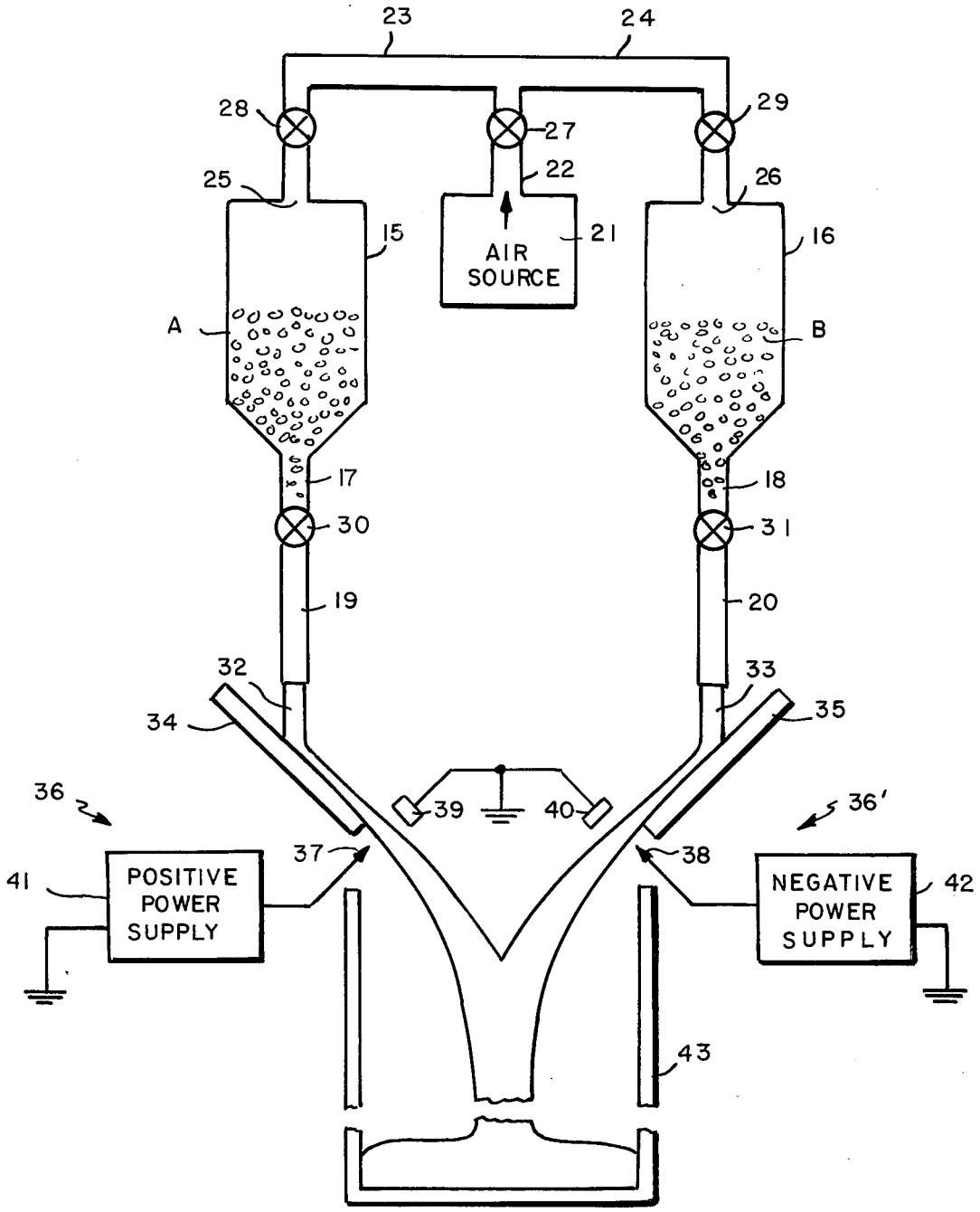
FIG. 3 shows a block diagram of an apparatus representing one embodiment of the invention for mixing particles.

The mixing quality of the system shown in FIG. 3 can be tested by taking appropriate samples at appropriate locations within the mixing chamber at a point downstream thereof wherein sufficient time has elapsed to provide the mixing operation desired by the charging process. For example, in a typical system of the type described analysis of twenty samples of polyvinyl chloride powder coating resin particles A having a natural color and particles B thereof being dyed with an identifiable color, all of the particles all being of approximately uniform average size of about 88 microns, a mixing quality M of less than unity was found, indicating an improved mixing quality over that expected by random mixing.

Figure 4:
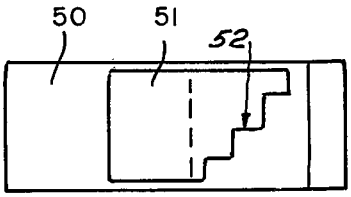
FIGS. 4 and 4A show diagrammatic views of a microscopic slide as set up to examine samples of a mixture made in accordance with the invention.
Figure 4A:
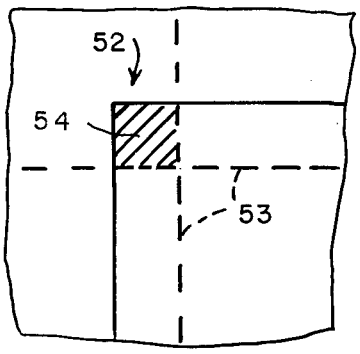

One method of analyzing samples which is useful in determining the mixing quality is to catch the falling powder stream in the mixing chamber on microscope slides covered with double stick masking tape having appropriate tackiness to hold substantially a single layer of particles. As shown in FIG. 4, the slide 50 can be placed under the microscope of an optical micrometer (not shown) and a stair-shaped template 51 placed over it. An inside corner 52 of the template (see the enlarged portion thereof in FIG. 4A) defines the locations at which particle counts are taken. The optical micrometer table on which the slide is placed is manipulated so that the template corner 52 and the microscope cross-hairs 53 form a square sample 54 containing the desired number of particles and the numbers of particles of each type are then counted for each sample. When all of the samples are counted the deviation is computed and the mixing index M is thereupon determined.

In using the system to mix the particles as described above in specific implementations thereof it was found that the mixing index M varied from about 0.44 to about 0.65 (better than random mixing), while a mixing index of greater than 2.0 (worse than random mixing) occurred when the particles were uncharged, thereby verifying the improved mixing quality achieved with the system of the invention.

In achieving the desired operation of the method and apparatus of the invention to produce a better than random mixture therefrom, the combining of the charged particles must take place over a sufficient time period and the particles must be sufficiently mobile over such time period to permit an effective mixing operation to take place. In the above examples the mixing times were from about 4.5 seconds to about 0.5 seconds, that is the time from which the charged particles came into contact at the top of a mixing chamber until they essentially reached a resting, or non-mobile, state at a region at or near the bottom of a mixing chamber at which point the mixing process ceased.

What is claimed is:

1. A method for mixing solid particles of two different types comprising the steps of charging the particles of a first type with an electrical charge having a first polarity;

charging the particles of a second type with an electrical charge having a second polarity; and causing said charged particles of both types to come into contact, said charged particles remaining in a substantially mobile state over a selected time period such that said particles combine to form a mixture having a mixing quality better than that of a random mixture thereof.

2. A method in accordance with claim 1 wherein said charging steps comprise forming a first corona discharge region;

passing particles of said first type through said first corona discharge region for providing a positive charge on said first particles;

forming a second corona discharge region; and passing particles of said second type through said second corona discharge region for providing a positive charge on said second particles.

3. A method in accordance with claim 2 and further including the steps of forming a first stream of said first particles;

forming a second stream of said second particles; and directing said first and second streams through said first and second corona discharge regions, respectively.

4. A method in accordance with claim 3 and further including directing the charged particles in said first and second streams into a mixing chamber so as to bring said streams into contact and to cause said charged particles to remain mobile within said chamber over said selected time period to form a mixture thereof.

5. A method in accordance with claim 4 and further including the step of selecting the voltage level at each of said corona discharge regions to provide an electric field across said region which is in a range from about 5 kv./cm. to about 15 kv./cm.

6. An apparatus for mixing solid particles of two different types comprising first means for charging the particles of one type with an electrical charge having a first polarity;

second means for charging the particles of the other type with an electrical charge having a second polarity; and means for combining said charged particles of said one and said other types to form a mixture thereof.

7. An apparatus in accordance with claim 6 wherein said first and second charging means each comprise first and second corona discharge means for charging the particles of said one and said other types.

8. An apparatus in accordance with claim 7 and further including first and second means for storing said particles of said one and said other types in an uncharged state;

first and second means for conveying said uncharged particles of said one and said other types in first and second streams thereof, respectively, to said first and second corona discharge means, respectively; and first and second means for further conveying said charged particles of said one and said other types from said corona discharge means to said combining means so as to bring said charged particles into contact therein.

9. An apparatus in accordance with claim 8 wherein said first and second corona discharge means each include power supply means for providing a voltage across the corna discharge region thereof, the voltage being at a sufficient level to provide an electric field sufficient to ionize the air particles in said region to form a corona discharge in said region.

10. An apparatus in accordance with claim 9 wherein said voltage level in each of said power supplies is selected so that the electric field is in a range from about 5 kv./cm. to about 15 kv./cm.

* * * * *